United States Patent [19]

Escamilla, Jr.

[11] Patent Number: 4,630,037

[45] Date of Patent: Dec. 16, 1986

[54] SMOKING VIOLATION DETECTOR

[75] Inventor: Victor Escamilla, Jr., Galveston, Tex.

[73] Assignees: Roy P. Gaspard, Texas City; Daniel Escamilla, Galveston, both of Tex.; part interest to each

[21] Appl. No.: 630,986

[22] Filed: Jul. 16, 1984

[51] Int. Cl.[4] ..... G08B 17/10

[52] U.S. Cl. ..... 340/628; 4/460; 4/661; 52/199; 340/693

[58] Field of Search ..... 340/628, 630, 693; 52/1, 199, 200; 4/460, 459, 449, 218, 211, 661; 98/42.23, 42.05, 42.13; 62/DIG. 16

[56] References Cited

U.S. PATENT DOCUMENTS

| | | | |
|---|---|---|---|
| 2,244,507 | 6/1941 | Thomas | 340/630 X |
| 3,205,351 | 9/1965 | Walker | 52/200 X |
| 3,521,414 | 7/1970 | Malissa | 52/200 X |
| 3,742,659 | 7/1973 | Drew | 52/199 X |
| 3,934,383 | 1/1976 | Perry et al. | 52/199 X |
| 4,090,435 | 5/1978 | Vallée | 52/199 X |
| 4,177,461 | 12/1979 | Brown et al. | 340/628 |
| 4,379,712 | 4/1983 | Sperr, Jr. et al. | 62/DIG. 16 |

*Primary Examiner*—James L. Rowland
*Assistant Examiner*—Daniel Myer
*Attorney, Agent, or Firm*—Harvey B. Jacobson

[57] ABSTRACT

A portable industrial toilet cabin is provided with a smoke-sensitive alarm unit for detecting smoking by an occupant of the toilet and emitting an alarm signal responsive thereto. The unit is useful, for example, in industrial and like areas where smoking is a hazard and is therefore prohibited. The unit may be mounted around a purpose-formed opening in an inclined roof of the cabin by a specialized adapter that mounts the unit in a horizontal disposition, and which may include a security screen for preventing occupants of the toilet from tampering with the alarm unit.

1 Claim, 4 Drawing Figures

FIG. 1
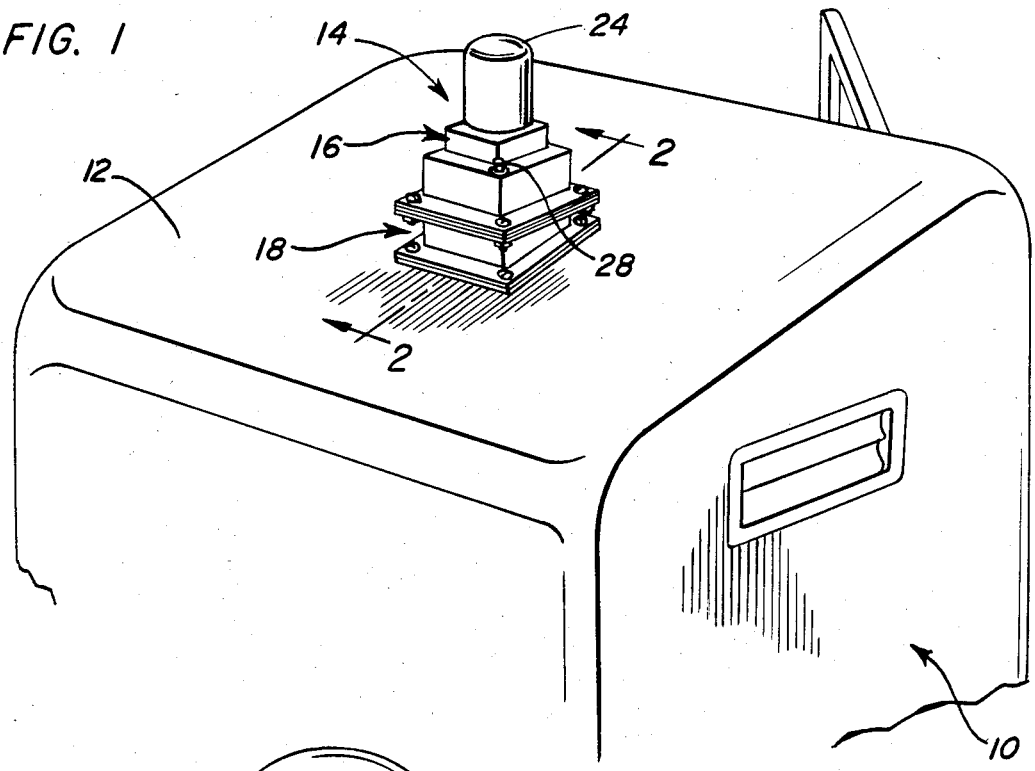
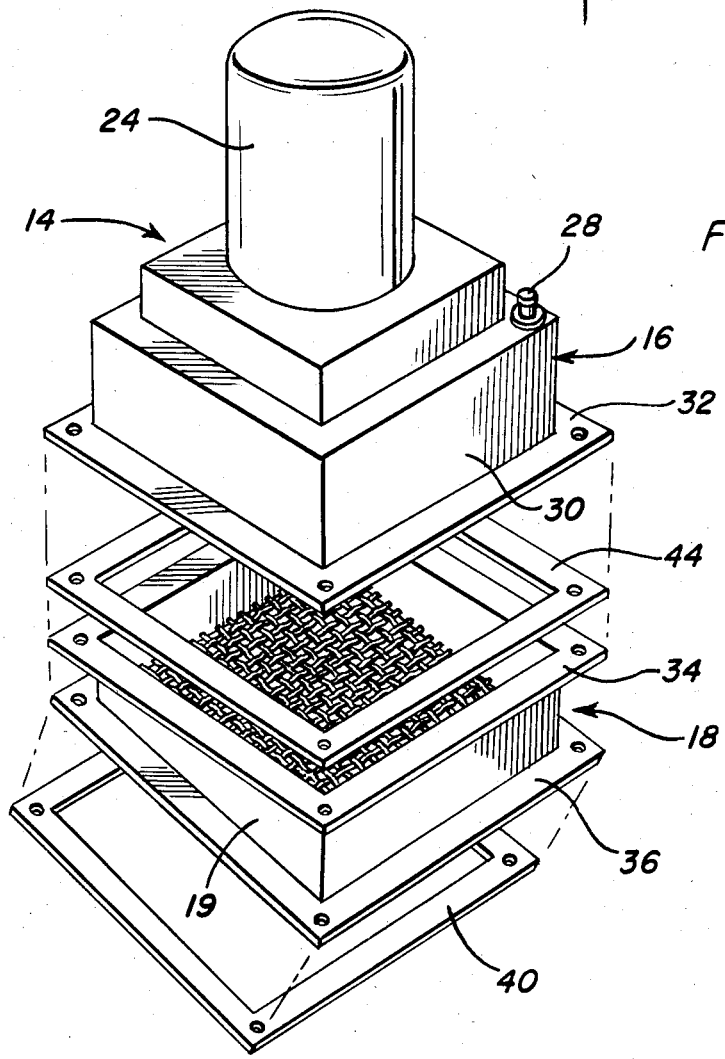
FIG. 4

SMOKING VIOLATION DETECTOR

BACKGROUND OF THE INVENTION

In commercial and/or industrial environments where smoking is a hazard and therefore prohibited due, for example, to the presence of dangerous gases or the like, it is notoriously commonplace for personnel who smoke to sneak into a toilet to do so. The present invention provides a solution to this problem, at least so far as portable industrial toilets are concerned, by the provision of a smoking detection and alarm unit used in association with such toilets.

STATEMENT OF PRIOR ART

The following U.S. patents relate to smoke detection and alarm devices. None of these, however, addresses itself specifically to the situation outlined above, nor do any of the patents provide a solution thereto, as does the present invention.

U.S. Pat. No. 4,189,720
U.S. Pat. No. 4,358,760
U.S. Pat. No. 4,365,237
U.S. Pat. No. 4,417,235

SUMMARY OF THE INVENTION

In accordance with the invention, there is provided smoking violation detection and alarm apparatus for use in conjunction with a portable industrial toilet comprising, for example, an electronic smoke-activated audio-visual alarm unit, and means for suitably mounting same over a purpose-formed opening in the roof of a portable toilet cabin.

Battery-operated, smoke-activated alarms which emit both audible and visual signals are known, and the invention contemplates the use of a unit of this nature mounted externally atop the roof of a portable toilet cabin over the aforesaid roof opening, so as to be sensitive to cigarette or like smoke emanating from within the cabin. Further in accordance with the invention, there is provided a mounting assembly for suitably securing the alarm unit on the cabin roof over a preformed roof opening, in a manner compensating for the slope of the roof, so that the unit may be mounted on the horizontal, and the assembly may incorporate suitable leak-proof and smoke-proof gaskets. The mounting assembly may further incorporate a security screen or the like for preventing occupants of the toilet cabin from tampering with the alarm unit.

Further in accordance with the invention, a portable toilet cabin may be provided with a roof opening surrounded by a suitable mount for the in situ attachment of a smoking detection alarm unit as aforesaid, in place of a removable cover with which the mount may normally be provided.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWINGS

FIG. 1 is a perspective view of the upper part of a portable toilet cabin equipped with smoking violation detection apparatus in accordance with the invention.

FIG. 4 is an exploded view of the apparatus.

DESCRIPTION OF PREFERRED EMBODIMENT

Figure 2:
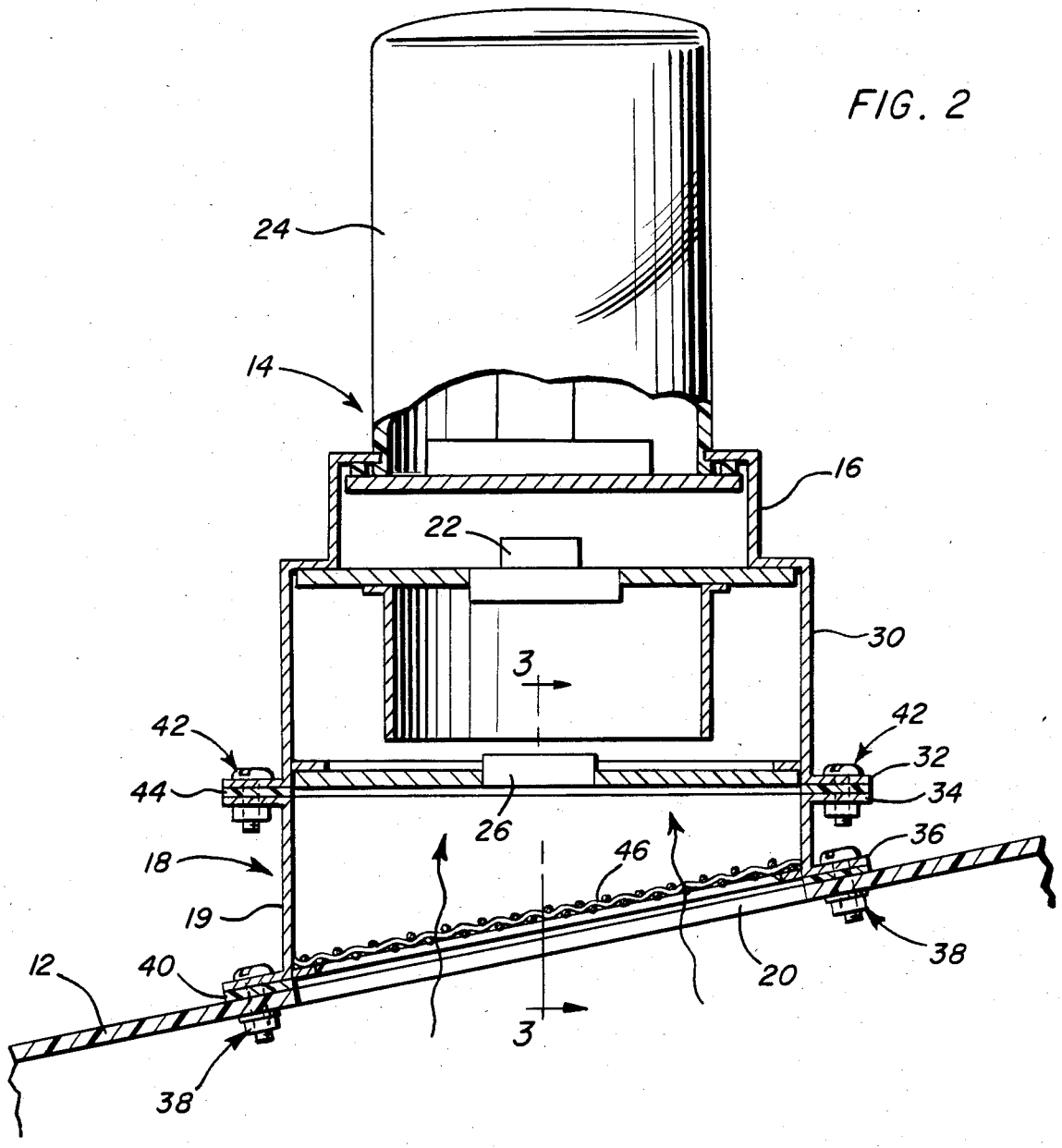
FIG. 2 is an enlarged sectional view on line 2—2 of FIG. 1.
Figure 3:
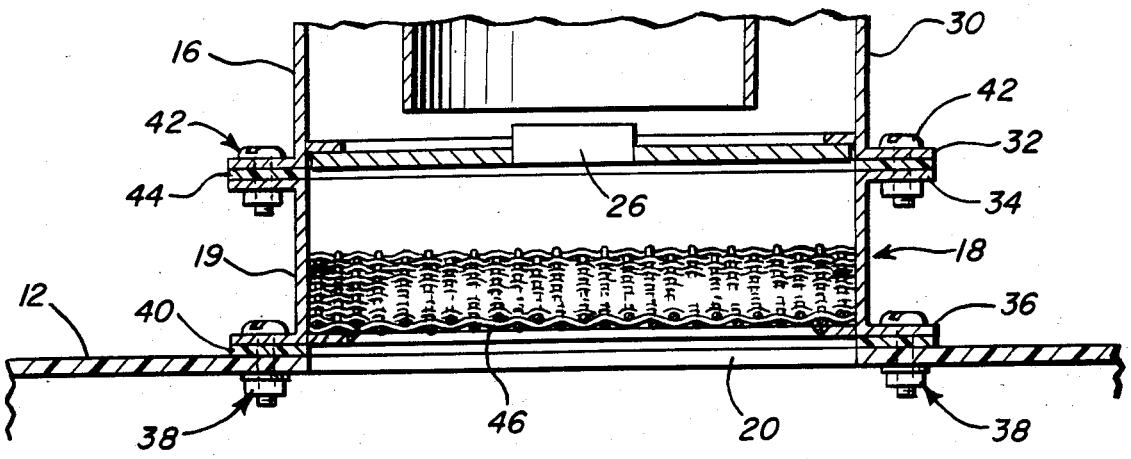
FIG. 3 is a sectional view on line 3—3 of FIG. 2.

Referring in detail to the drawings, a portable industrial toilet having a cabin 10 which may be molded in fiber glass, for example, has a sloping roof 12 on which is a fixed smoking violation and detection apparatus in accordance with the invention, generally indicated at 14, in order to apprehend a person who may smoke in the toilet contravening requirements to the contrary. Apparatus 14 comprises a battery-operated electronic smoke-sensitive alarm unit 16 of rectangular box-like form, and a flanged tubular adapter fitting 18 for mounting the unit on the roof 12 in horizontal disposition over a purpose-made rectangular opening 20 suitably cut or otherwise formed in the roof.

Alarm unit 16 may be of a known, commercially available type, adapted for example, to emit an audible alarm from a buzzer 22 or the like inside of the unit, as well as a visual signal, for example in the form of a flashing light visible through a translucent dome 24 at the top of the unit, responsive to the detection of smoke and like fumes by a smoke-detecting sensor 26. The flashing light may be activated by an audio-signal emitted from the audible alarm, in order to prevent accidental operation of the light, and the dual-type alarm provides additional security as compared with a single visual or audible alarm. The units equipped internally with batteries (not shown) and a test button 28 to allow for regular maintenance checks. Smoke detecting alarm units of this nature are known. The electronics associated with the unit does not form part of the present invention, and will not therefore be described herein in detail.

In the illustrated embodiment, alarm unit 16 is shown as having a box-like lower portion 30 of rectangular cross section with a peripherally extending attachment flange 32, and adapter fitting 18 is similarly formed of rectangular cross section. It is apparent, however, that alarm units of different shapes may also be used, and that the shape of fitting 18 can be modified to suit within the scope of the invention. Fitting 18, which may be fabricated from metal sheet, is wedge-shaped in elevation in order to compensate for the slope of roof 12 and mount unit 14 in a horizontal position, the fitting having a wedge-shaped body portion 19, and being provided with upper and lower peripheral flanges 34, 36. The lower flange may be attached to roof 12 around opening 20 by screw-and-nut attachments 38 secured in suitable holes formed for this purpose in the roof and flange. A first sealing gasket 40, of rubber or the like, may be interposed between the roof and flange 36. Upper flange 34 is similarly attached to flange 32 of the alarm unit with screw-and-nut attachments 42 and a second interposed gasket 44 of rubber or the like. The gaskets serve to seal opening 20 against ingress of rain, and also ensure against outward egress of smoke through the joints. Internally, fitting 18 may be provided with a wire screen, grille, or grid 46 or the like, suitably welded in place, to prevent an occupant of the toilet tampering with the alarm mechanism.

The toilet cabin may be supplied with fitting 18 in place ready to receive alarm unit 16, and a blind cover (not shown) may be provided to fit on flange 34 in place of the alarm unit. In a non-illustrated modification of the invention, the cabin roof may be formed with an integral fitting similar to fitting 18, in place of the illustrated attachable and detachable fitting.

It will be appreciated that the invention provides a useful adjunct for portable toilets, providing same with a convenient means for apprehending smoking violation offenders.

The foregoing is considered as illustrative only of the priniples of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A portable industrial toilet cabin having a roof opening, a smoke-sensitive smoking violation detection and alarm unit mounted on the exterior of the roof over said opening for emitting an alarm signal in response to smoke emanating from within the cabin, and security means for preventing an occupant of the cabin from tampering with said unit, wherein the alarm unit comprises signal emitter means externally of the cabin for signalling the presence of smoke within the cabin to personnel outside the cabin, and sensing means for activating said emitter means responsive to the presence of smoke in the cabin, wherein the roof of the cabin is inclined and the alarm unit is mounted in horizontal disposition by a wedge-shaped tubular adapter extending from the roof around the opening, and wherein the adapter includes a security screen outside of the cabin constituting the security means.

* * * * *